US006983600B1

(12) United States Patent
Dinu et al.

(10) Patent No.: US 6,983,600 B1
(45) Date of Patent: Jan. 10, 2006

(54) MULTI-VENTURI TUBE FUEL INJECTOR FOR GAS TURBINE COMBUSTORS

(75) Inventors: Constantin Alexandru Dinu, Greer, SC (US); Iris Ziqin Hu, Greer, SC (US); James Michael Storey, Taylors, SC (US); Thomas Raymond Farrell, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 131 days.

(21) Appl. No.: 10/879,279

(22) Filed: Jun. 30, 2004

(51) Int. Cl.
*F02C 1/00* (2006.01)
*F02G 3/00* (2006.01)

(52) U.S. Cl. ..... 60/737; 60/723; 60/39.822

(58) Field of Classification Search ..... 60/737, 60/723, 740, 742, 747, 39.822
See application file for complete search history.

(56) References Cited

U.S. PATENT DOCUMENTS 3,143,401 A * 8/1964 Lambrecht ..... 48/180.1
3,643,431 A * 2/1972 Jamieson ..... 60/738
4,226,087 A * 10/1980 Spadaccini ..... 60/749
4,356,698 A * 11/1982 Chamberlain ..... 60/733
4,845,952 A 7/1989 Beebe
4,966,001 A 10/1990 Beebe
5,161,366 A * 11/1992 Beebe ..... 60/777
5,826,429 A * 10/1998 Beebe et al. ..... 60/723
5,850,731 A * 12/1998 Beebe et al. ..... 60/778
5,924,276 A * 7/1999 Mowill ..... 60/39.23
6,220,034 B1 * 4/2001 Mowill ..... 60/737
6,250,066 B1 * 6/2001 Lawrence et al. ..... 60/39.23
6,442,939 B1 * 9/2002 Stuttaford et al. ..... 60/737
6,460,345 B1 * 10/2002 Beebe et al. ..... 60/777
6,886,341 B2 * 5/2005 Inoue et al. ..... 60/737

* cited by examiner

*Primary Examiner*—William H. Rodriguez
(74) *Attorney, Agent, or Firm*—Nixon & Vanderhye, P.C.

(57) ABSTRACT

A combustor for a gas turbine includes a main fuel injector for receiving compressor discharge air and mixing the air with fuel for flow to a downstream catalytic section. The main fuel injector includes an array of venturis each having an inlet, a throat and a diffuser. A main fuel supply plenum between forward and aft plates supplies fuel to secondary annular plenums having openings for supplying fuel into the inlets of the venturis upstream of the throats. The diffusers transition from a circular cross-section at the throat to multiple discrete angularly related side walls at the diffuser exits without substantial gaps therebetween. With this arrangement, uniform flow distribution of the fuel/air, velocity and temperature is provided at the catalyst inlet.

22 Claims, 6 Drawing Sheets

MULTI-VENTURI TUBE FUEL INJECTOR FOR GAS TURBINE COMBUSTORS

BACKGROUND OF THE INVENTION

The present invention relates to a fuel injector for gas turbine combustors and particularly relates to a multi-venturi fuel injector for catalytic and dry low-NOx applications.

The main components of a combustor for a gas turbine, for example, a catalytic combustor, include (1) a pre-burner which may typically constitute a diffusion style combustor that burns a small fraction of the fuel to elevate air temperature sufficiently to activate the catalyst downstream; (2) a pre-mixer which includes the main fuel injector and accomplishes fuel and air mixing; (3) a catalyst which partially converts the fuel in a flameless reaction in which no NOx is produced; and (4) a burn-out zone which includes homogeneous combustion in a post-catalyst liner of the lean fuel/air mixture flowing from the catalyst which does not generate NOx due to the relatively reduced temperature of the combustion. This type of combustor is capable of generating very low emissions.

A multi-venturi tube has been used in a catalytic combustor as a main fuel injector. See, for example, U.S. Pat. Nos. 4,845,952 and 4,966,001. These arrangements are intended to provide a uniform fuel/air mixture at the catalyst inlet. It will be appreciated that tight uniformity of the fuel distribution must be maintained over the large cross-sectional area at the catalyst inlet. Fuel/air mixing is accomplished by distributing the fuel among the large number of venturis that fill up the cross-section of the combustor followed by aerodynamic mixing inside the venturi tube as well as in the downstream region between the venturi exit plane and the catalyst inlet. In addition to uniform fuel/air mixture, the catalyst requires a uniform temperature and a uniform velocity across the catalyst inlet plane. Absent either one of these factors, the catalyst does not function optimally. It will also be appreciated that multiple venturi tubes produce laminar flow which suppresses large scale mixing and preconditions the flow such that only local mixing can be accomplished between the diffuser exit and the catalyst inlet. That is, mixing in that cross-sectional region is limited. For example, if a region of flow has a high temperature or velocity in comparison to the remaining flow, the thermal or velocity mal-distribution will deleteriously appear at the catalyst inlet. Accordingly, there is a need for a fuel injector for a gas turbine combustor affording improved uniform fuel/air, temperature and velocity distributions to the catalyst inlet.

BRIEF DESCRIPTION OF THE INVENTION

In accordance with the preferred aspect of the present invention, there is provided in combination in a combustor, a flow conditioner, a venturi configuration having a diffuser with multiple sides and an improved fuel circuit. The flow conditioner may be of the type described and illustrated in co-pending U.S. patent application Ser. No. 10/648,203 filed Aug. 27, 2003, the disclosure of which is incorporated herein by reference. In addition to the flow conditioner, multiple venturi tubes having a frustum-like cross-sectional configuration are provided to enhance fuel/air mixing, to afford uniform distribution of the fuel/air, velocity and temperature at the catalyst inlet, and to eliminate flame-holding issues. The venturi configuration eliminates recirculation regions, i.e., flow gaps between the venturis in the exit planes and downstream thereof, as well as the potential for flame-holding. The venturis have a three body construction to improve fuel distribution among the various venturis and also to improve mechanical durability by thermo-shielding of the brazed joints of the construction. The venturi fuel circuit provides a secondary plenum between the main fuel plenum surrounding the venturis defined between spaced axial forward and aft walls and fuel supply inlets to the converging inlet of the venturis. By providing a secondary plenum in each venturi, the plane of fuel intake into the plenum is separated from the plane of fuel injection into the venturi by a maximum available distance. Also cold fuel flow is directed along the cold side of the fuel plenum thereby minimizing thermal stress at the front and aft plate brazed joints.

In accordance with a preferred aspect of the present invention, there is provided a combustor for a gas turbine comprising a combustor housing including a flow liner for receiving compressor discharge air; a main fuel injector downstream of the flow liner for receiving the compressor discharge air and mixing air and fuel; a catalytic section downstream of the main fuel injector for receiving a mix of air and fuel from the main fuel injector; the main fuel injector including (i) an array of venturis each including a convergent inlet, a throat and a diffuser for flowing a fuel/air mixture therethrough in a generally axial direction for exit from said diffuser, (ii) a front plate and (iii) an aft plate surrounded by an enclosure defining a fuel supply plenum between the plates; each plate having a plurality of openings for receiving the venturis; and each venturi inlet having at least one fuel supply hole for supplying fuel from the fuel supply plenum into the venturi inlet at a location axially upstream from the throat.

In accordance with another aspect of the present invention, there is provided a combustor for a gas turbine comprising a combustor housing including a flow liner for receiving compressor discharge air; a main fuel injector downstream of the flow liner for receiving the compressor discharge air; a catalytic section downstream of the main fuel injector for receiving a mix of air and fuel from the main fuel injector; the main fuel injector including an array of venturis about a combustor axis, each venturi including a converging inlet, a throat and a diffuser for flowing the fuel/air mixture, each venturi including a fuel supply hole for flowing fuel into the venturi, said diffuser having multiple discrete angularly related side walls therealong, the array of venturis being arranged in circumferential side-by-side relation to one another about the axis and spaced radially from one another.

DETAILED DESCRIPTION OF THE INVENTION

Figure 1:
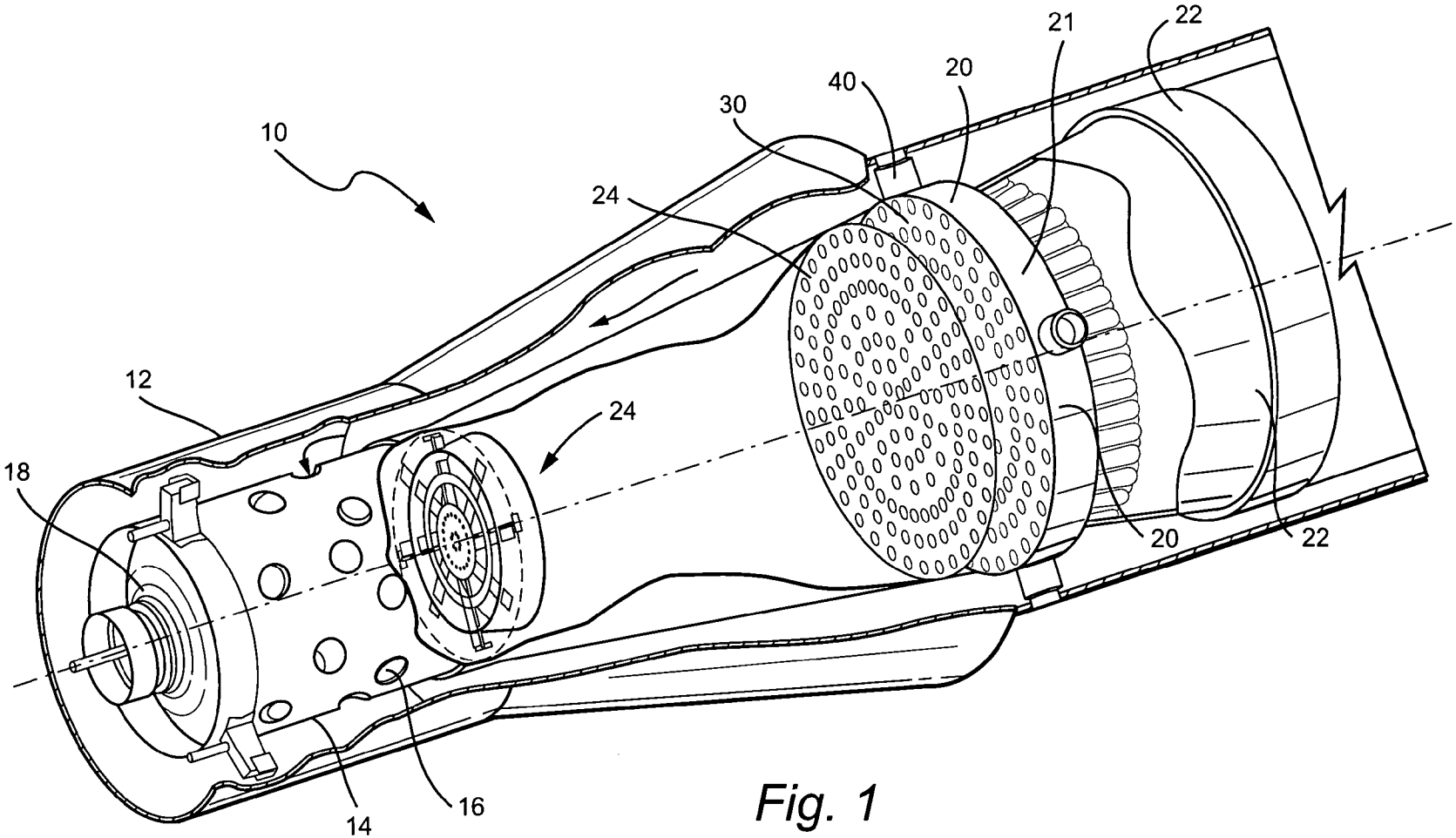
FIG. 1 is a fragmentary perspective view with parts broken out and in cross section illustrating a portion of a catalytic combustor for use in a gas turbine incorporating a multi-venturi tube arrangement according to a preferred aspect of the present invention.

As will be appreciated a typical gas turbine has an array of circumferentially spaced combustors about the axis of the turbine for burning a fuel/air mixture and flowing the products of combustion through a transition piece for flow along the hot gas path of the turbine stages whereby the energetic flow is converted to mechanical energy to rotate the turbine rotor. The compressor for the turbine supplies part of its compressed air to each of the combustors for mixing with the fuel. A portion of one of the combustors for the turbine is illustrated in FIG. 1 and it will be appreciated that the remaining combustors for the turbine are similarly configured. Smaller gas turbines can be configured with only one combustor having the configuration illustrated in FIG. 1.

Referring to FIG. 1 a combustor, generally designated 10, includes a preburner section 12 having an interior flow liner 14. Liner 14 has a plurality of holes 16 for receiving compressor discharge air for flow in the preburner section 12. Preburner section 12 also includes a preburner fuel nozzle 18 for supplying fuel to the preburner section. The flow of combustion products, from the preburner section has a center peaked flow distribution, i.e., both flow velocity and temperature, which does not result in the desired uniform flow to the additional fuel injectors, e.g., the venturi fuel type injectors described and illustrated in U.S. Pat. No. 4,845,952. The main fuel injector is designated 20 in FIG. 1 and forms part of a multi-venturi tube arrangement of which certain aspects are in accordance with a preferred embodiment of the present invention. The air and products of combustion from the preburner section 12 and the fuel from the fuel injector 20 flow to a catalyst or catalytic section 22. As a consequence there is a lack of uniformity of the flow at the inlet to the catalytic section 22. One effort to provide such uniformity, has resulted in the design of a flow controller generally designated 24 between the preburner section 12 and the fuel injector 20. Details of the flow conditioner 24 may be found in U.S. patent application Ser. No. 10/648,203 filed Aug. 27, 2003 for Flow Controller For Gas Turbine Combustors, the subject matter of which is incorporated herein by reference.

At the inlet to the multi-venturi tube arrangement 21 (hereinafter MVT) forming part of the main fuel injector 20, there is provided a perforated plate 24 to assist in conditioning the flow of fuel/air to obtain optimum mixing and uniform distribution of the flows and temperature at the inlet to catalytic section 22.

Figure 2:
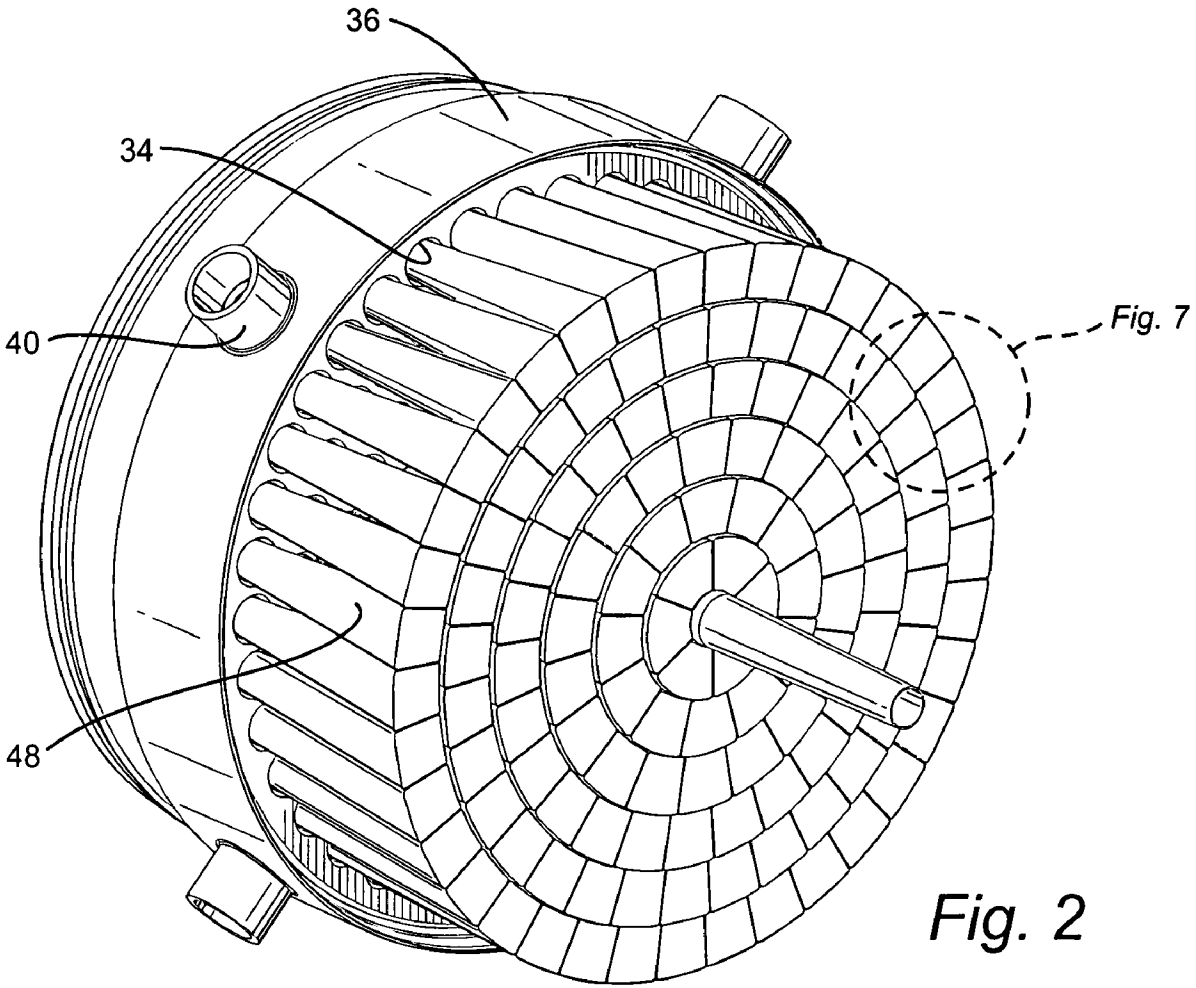
FIG. 2 is a perspective view of the multi-venturi tube arrangement.
Figure 3:
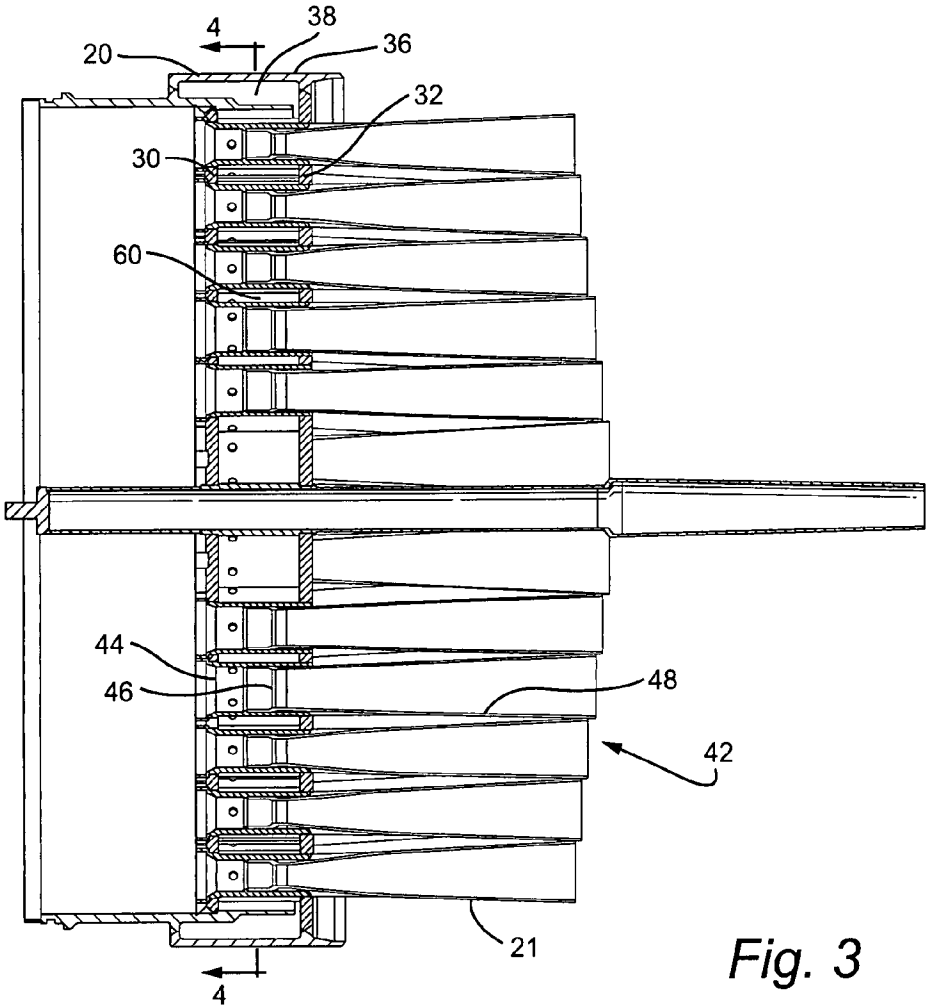
FIG. 3 is a cross-sectional view thereof.
Figure 4:
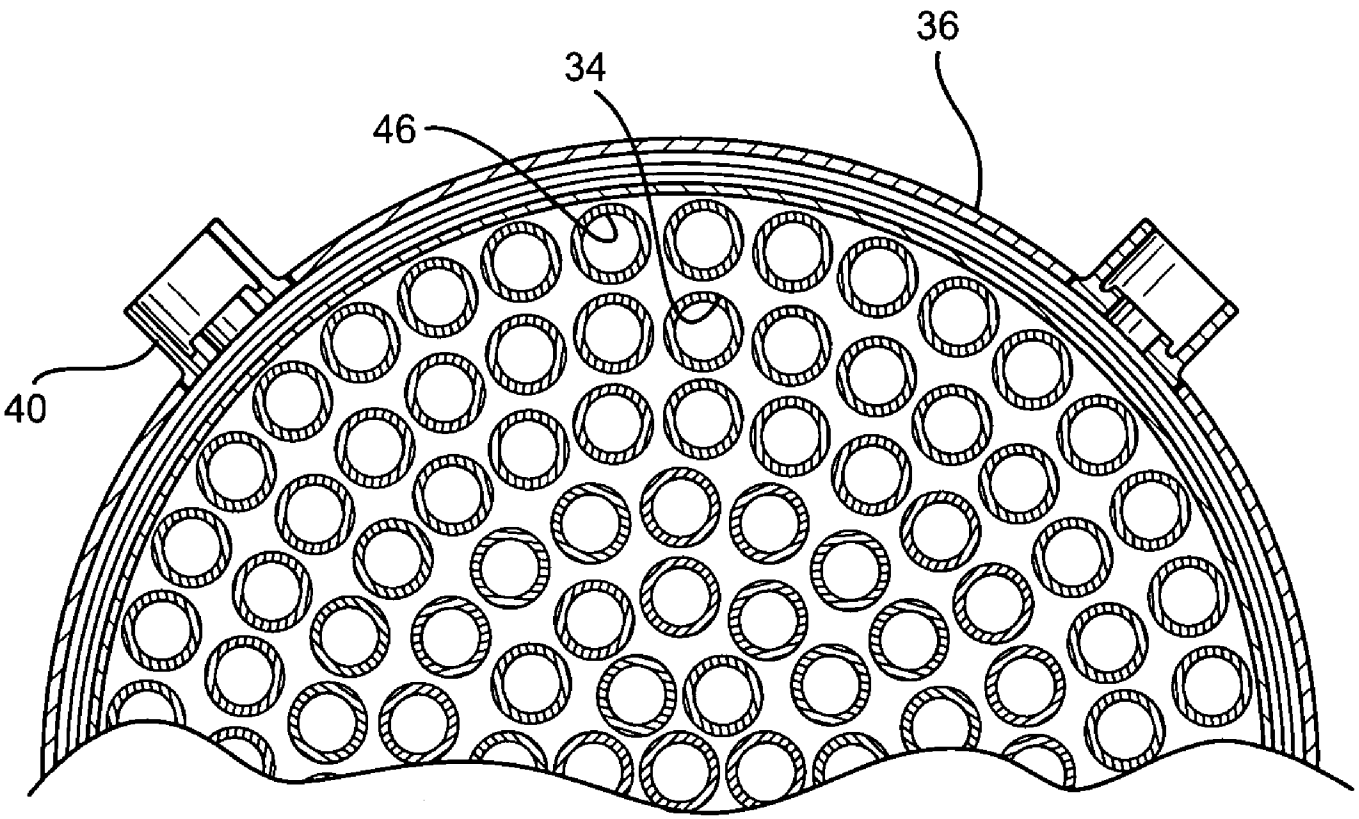
FIG. 4 is a cross-sectional view thereof taken generally about on line 4—4 in FIG. 3.
Figure 5:
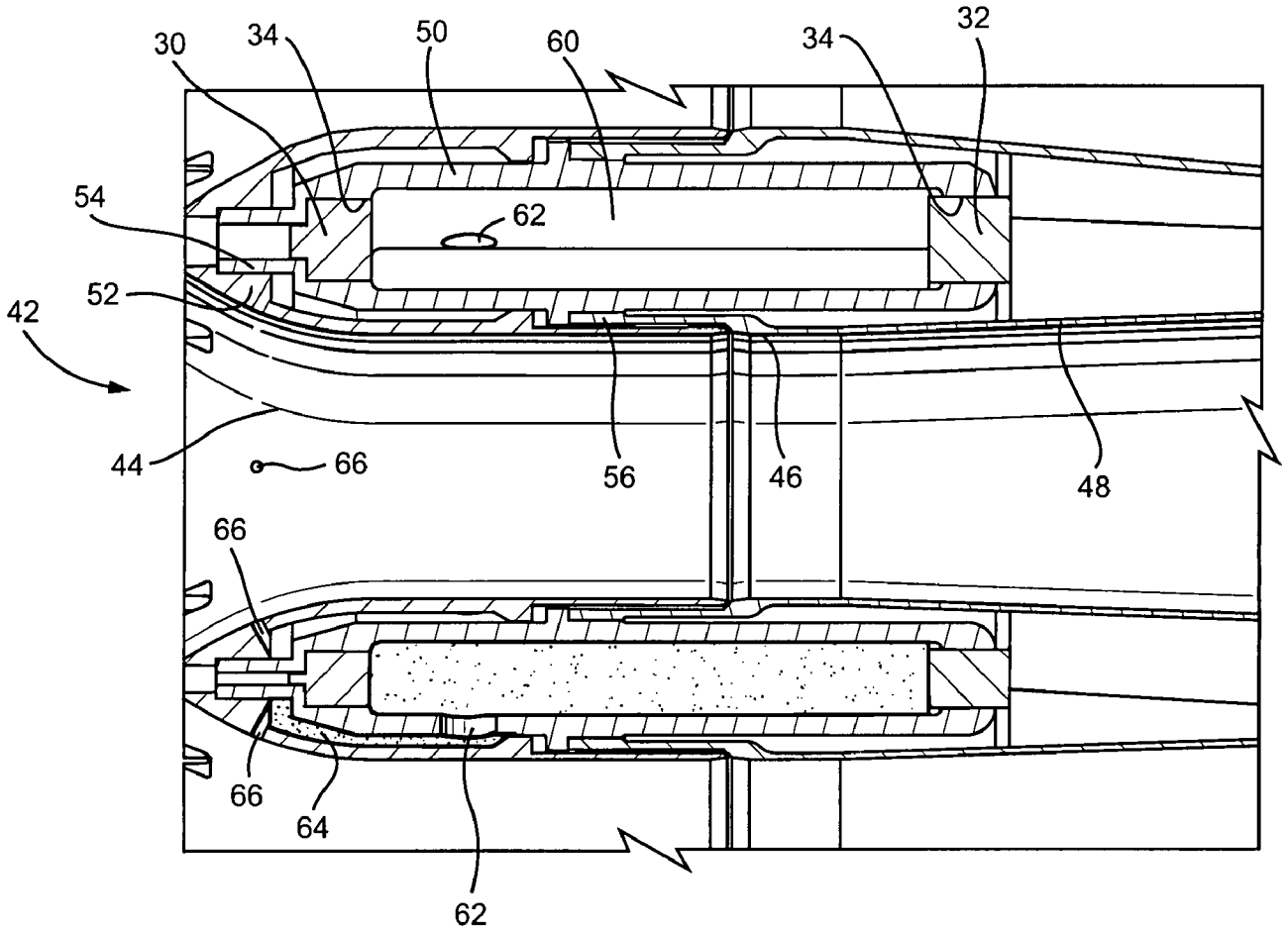
FIG. 5 is an enlarged fragmentary view with parts in cross-section illustrating a venturi and the fuel plenums.

The main fuel injector 20 includes a pair of axially spaced perforated plates, i.e. a front plate 30 and an aft plate 32 (FIGS. 1, 3 and 5). Plates 30 and 32 are perforated and form axially aligned annular arrays of openings, e.g., openings 34 in FIG. 4 of plate 30. A casing 36 defining a plenum 38 surrounds and is secured to the outer margins of the front and aft plates 30 and 32 respectively. As illustrated in FIGS. 2 and 4, a plurality of fuel inlets 40, four being shown, are equally spaced about the periphery of the casing 36 for supplying fuel to the plenum 38.

The openings through the plates 30 and 32 are closed by venturis generally designated 42 and forming part of the MVT 21. Thus each pair of axially aligned openings 34 through the plates 30 and 32 receive a venturi 42. Each venturi includes a converging inlet section 44, a throat 46 and a diverging section or diffuser 48. Each venturi is a three part construction; a first part including the inlet converging portion 44, a second part comprising the throat and diffuser 46 and 48, and a third part comprising an annular venturi member or body 50. Body 50 extends between each of the axially aligned openings in the front and aft plates 30 and 32 and is secured thereto for example by brazing. The converging inlet section 44 of the venturi 42 includes an inlet flange 52 which is screw threaded to a projection 54 of the body 50. The integral throat and diffuser 46 and 48, respectively, has an enlarged diameter 56 at its forward end which surrounds the aft end of the inlet 44 and is secured, preferably brazed, thereto.

It will be appreciated that the space between the front and aft plates 30 and 32 and about the annular bodies 50 of each venturi constitutes a main fuel plenum 60 which lies in communication with the fuel inlets 40. The main fuel plenum 60 lies in communication with each inlet section 44 via an aperture 62 through the annular body 50, a mini fuel plenum 64 formed between the body 50 and the inlet 44 and supply holes 66 formed adjacent the leading edge of the inlet section 44. The fuel supply holes 66 are spaced circumferentially one from the other about the inlet 44 and preferably are four in number. It will be appreciated that the fuel inlet holes 66 to the venturi are located upstream of the throat 46 and in the converging section of the inlet section 44. Significantly improved mixing of the fuel/air is achieved by locating the fuel injection holes 66 in the converging inlet section of the venturi without flow separation or deleterious flame holding events.

Fuel from the fuel inlet plenum 38 circulates between the front and aft plates 30 and 32 and about the annular bodies 50 for flow into the venturis 42 via the fuel apertures 62, the mini plenums 64 between the inlet sections 44 and annular bodies 50 and the fuel inlet holes 66. With the fuel inlet holes located adjacent the inlets to the converging sections of the venturis, the fuel is injected in a region where the air side pressure is higher, e.g., compared to static pressure at the throat. It will be appreciated that the magnitude of the fuel/air mixing taking place in each venturi is directly related to the jet penetration which in turn depends on the pressure ratio across the fuel injection holes 66 and the jet momentum ratio, i.e., between the jets and the main flow stream. To increase the pressure ratio and decouple the fuel injection from airflow distribution, the fuel holes are located upstream of the throat. The fuel is therefore injected in a region where the air-side pressure is higher compared to the static pressure at the throat and therefore, for the same fuel side effective area, the pressure ratio is increased. An optimum pressure ratio-circumferential coverage is achieved. Air velocity is also lower than at the throat and therefore the jets of fuel adjacent the venturi inlet sections 44 develop under better conditions from a momentum ratio standpoint. Further, improved air fuel mixing due to this fuel inlet location is achieved also by the increased mixing length, i.e., the actual travel distance inside the venturi for the same overall length of tube. Additionally, the venturis 42 are fixed between the two plates 30 and 32 to form the main fuel plenum 60 between the plates and the outside surfaces of the venturis. Fuel is introduced into plenum 60 from the outside diameter. A general flow of fuel with some axial symmetry occurs from the outside diameter of the plenum toward the center of the MVT as the venturis are fed with fuel. Thus, a potential imbalance in fuel flow around the tubes and among the tubes with a penalty in mixing performance which occurs with fuel injection at the venturi throats is avoided since the fuel injection holes into the venturis are spatially displaced from a plane in which the general plenum flow occurs. Finally, because the fuel inlet injection holes 66 are located adjacent the venturi inlet section 44, the potential for fuel jet induced flow separation inside the venturis is greatly reduced.

Figure 7:
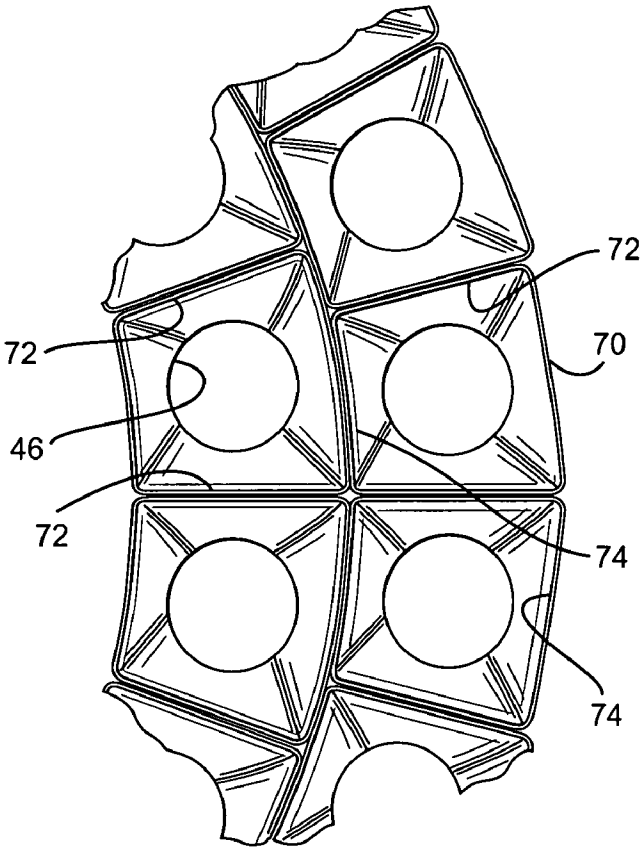
FIG. 7 is an enlarged fragmentary end view of the diverging sections of the multi-venturi tubes as viewed in an upstream direction.
Figure 6:
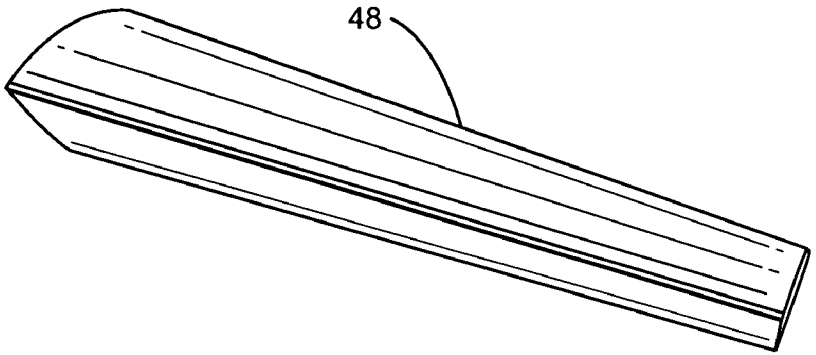
FIG. 6 is a fragmentary perspective view of a portion of the diverging tube of the venturi.

Referring now to FIGS. 2, 6 and 7, each diffuser 48 transitions from a circular shape at the throat 46 to a generally frustum shape at the exit. That is, the diffuser 48 transitions from a circular shape at the throat into multiple discrete angularly related sides 70 (FIG. 7). Sides 70 terminate in circumferentially spaced radially extending side walls 72 as well as radially spaced circumferentially extending arcuate side walls 74 opposite one another. As illustrated, the diffusers 48 are arranged in circular patterns to achieve an axisymmetric geometry by transitioning from circular throat areas to generally frustum areas at their exits. Any gaps between the adjacent venturis both in a radial and circumferential directions are substantially eliminated as can be seen in FIGS. 2 and 7. Thus, as illustrated in FIG. 7, the radial extending walls 72 of each diffuser at each venturi exit lie in contact with and are secured to the corresponding wall 72 of the circumferentially adjacent diffusers. Similarly, the arcuate walls 74 of each diffuser exit lie in contact with adjacent walls 74 of the next radially adjacent diffuser exit. Also, the venturis are arranged in a pattern of circular arrays at different radii about the axis. Thus, gaps between the radially and circumferentially adjacent diffuser exit walls are minimized or eliminated at the exit plane. Previously, for example, as illustrated in U.S. Pat. No. 4,845,952, the exit plane of the venturi diffusers had large gaps between the circular exits. Those interventuri gaps produced large recirculation regions downstream of the exit plane which are filled in by the exit flow from the circular venturis. By transitioning from the circular cross-section at the throat of the venturis to generally frustums at the exit plane of the venturis with minimized or eliminated gaps between circumferentially and radially adjacent venturi exits, these prior large recirculation regions formed downstream of the venturi exits and the risk for flame holding are greatly reduced or eliminated. It will also be appreciated that by providing each venturi in a multi part construction, i.e., an inlet 44 and a combined throat and diffuser section 46, 48, the inlet 44 can be removed for tuning, refurbishing or testing flexibility purposes.

Further, from a review of FIG. 3, the venturi exits are stepped towards the outside diameter and in an upstream direction. That is, the venturi exits are spaced axially increasing distances from a plane normal to the flow through the combustor in a radial outward upstream direction. This enables any gap between adjacent venturis to be further reduced. Also, by making the radial outer venturis shorter, the angle of the exit diffuser is reduced, e.g. to about 7.8° thereby reducing the potential for flow separation in the exit diffuser.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor for a gas turbine comprising a combustor housing including a flow liner for receiving compressor discharge air;

a main fuel injector downstream of said flow liner for receiving the compressor discharge air and mixing air and fuel;

a catalytic section downstream of said main fuel injector for receiving a mix of air and fuel from the main fuel injector;

said main fuel injector including (i) an array of venturis each including a convergent inlet, a throat and a diffuser for flowing a fuel/air mixture therethrough in a generally axial direction for exit from said diffuser, (ii) a front plate and (iii) an aft plate surrounded by an enclosure defining a fuel supply plenum between said plates;

each said plate having a plurality of openings for receiving the venturis; and each said venturi inlet having at least one fuel supply hole for supplying fuel from said fuel supply plenum into said venturi inlet at a location axially upstream from said throat.

2. A combustor according to claim 1 including a secondary plenum in communication between said fuel supply plenum and said fuel supply hole.

3. A combustor according to claim 2 wherein each said venturi includes a venturi member about said convergent inlet, said member including an aperture in communication with said secondary plenum, said secondary plenum lying between said inlet and said member.

4. A combustor according to claim 1 wherein said one fuel supply hole in said inlet is located axially closer to an entrance to said inlet than the throat.

5. A combustor according to claim 1 wherein each said venturi includes a venturi member about said convergent inlet, said member including an aperture in communication with a secondary plenum, said secondary plenum lying between said inlet and said member, said member and said inlet of each venturi being screw threaded to one another and said diffuser and said throat being brazed to one another.

6. A combustor according to claim 1 wherein each said diffuser has multiple discrete angularly related side walls terminating at an outlet remote from said throat.

7. A combustor according to claim 6 wherein said throat has a circular cross-section and said diffuser transitions smoothly from said throat to said outlet.

8. A combustor according to claim 6 wherein said side walls of said diffuser include two opposed arcuate wall surfaces.

9. A combustor according to claim 6 wherein said side walls of said diffuser includes a pair of linearly extending side wall surfaces.

10. A combustor according to claim 6 wherein said side walls of said diffuser include two opposed, radially spaced, arcuate wall surfaces and a pair of linear extending circumferentially spaced side wall surfaces.

11. A combustor according to claim 6 wherein said array of venturis are arranged in circumferential side by side relation to one another about an axis.

12. A combustor according to claim 11 wherein circumferentially adjacent diffusers of said venturis have adjoining, circumferentially spaced, radially extending side walls.

13. A combustor according to claim 12 wherein said adjoining side walls extend linearly along radii about said axis.

14. A combustor according to claim 11 wherein said array of venturis are arranged in multiple circular arrays thereof at different radii relative to said axis, radially adjacent diffusers of said venturis having arcuate adjoining side walls.

15. A combustor according to claim 14 wherein said venturis are disposed in generally concentric rows about said axis.

16. A combustor according to claim 15 wherein circumferentially adjacent diffusers of said venturis have adjoining, circumferentially spaced, radially extending side walls.

17. A combustor according to claim 11 wherein said venturis are disposed in generally concentric rows about said axis, said throats of said venturis lying in a common plane normal to said axis, said venturis terminating in said multiple angularly related side walls defining exit openings staggered in an axial direction, said exit openings of radially innermost venturis being spaced from corresponding throats thereof distances greater than the distances radially outermost exit openings are spaced from corresponding throats thereof.

18. A combustor according to claim 17 wherein said diffuser exit openings are staggered in an axial upstream direction and in increasing radial outward directions.

19. A combustor for a gas turbine comprising:

a combustor housing including a flow liner for receiving compressor discharge air;

a main fuel injector downstream of said flow liner for receiving the compressor discharge air;

a catalytic section downstream of said main fuel injector for receiving a mix of air and fuel from the main fuel injector;

said main fuel injector including an array of venturis about a combustor axis, each said venturi including a converging inlet, a throat and a diffuser for flowing the fuel/air mixture, each said venturi including a fuel supply hole for flowing fuel into the venturi, each said diffuser having multiple discrete angularly related side walls therealong, said array of venturis being arranged in circumferential side-by-side relation to one another about said axis and spaced radially from one another.

20. A combustor according to claim 19 wherein said angularly related side walls of each diffuser terminate at an outlet remote from said throat, said throat having a circular cross section and said diffuser transitioning smoothly from said throat to said outlet.

21. A combustor according to claim 20 wherein said side walls of said diffuser include two opposed, radially spaced, arcuate wall surfaces and a pair of linear extending circumferentially spaced side wall surfaces.

22. A combustor according to claim 20 wherein said venturis are disposed in generally concentric rows about said axis, said throats of said venturis lying in a common plane normal to said axis, said venturis terminating in said multiple angularly related side walls defining exit openings staggered in an axial direction, said exit openings of radially innermost venturis being spaced from corresponding throats thereof distances greater than the distances radially outermost exit openings are spaced from corresponding throats thereof.

* * * * *